US005874915A

United States Patent [19]

Lee et al.

[11] Patent Number: 5,874,915

[45] Date of Patent: Feb. 23, 1999

[54] WIDEBAND CYLINDRICAL UHF ARRAY

[75] Inventors: Jar J. Lee, Irvine; Ruey S. Chu, Cerritos; Kenneth L. Schaffer, Diamond Bar, all of Calif.

[73] Assignee: Raytheon Company, Lexington, Mass.

[21] Appl. No.: 907,569

[22] Filed: Aug. 8, 1997

[51] Int. Cl.[6] ..... H01Q 3/22

[52] U.S. Cl. ..... 342/375; 342/372; 342/373; 342/374

[58] Field of Search ..... 342/375, 372, 342/373, 374, 154, 157

[56] References Cited

U.S. PATENT DOCUMENTS

| | | | |
|---|---|---|---|
| 4,814,773 | 3/1989 | Wechsberg et al. | 342/368 |
| 5,012,254 | 4/1991 | Thompson | 342/373 |
| 5,132,694 | 7/1992 | Sreenivas | 342/373 |
| 5,414,433 | 5/1995 | Chang | 342/375 |
| 5,428,364 | 6/1995 | Lee et al. | 343/767 |
| 5,583,516 | 12/1996 | Lembo | 342/375 |

*Primary Examiner*—Thomas Tarcza
*Assistant Examiner*—Dac L. Phan
*Attorney, Agent, or Firm*—Leonard A. Alkov; Glenn H. Lenzen, Jr.

[57] ABSTRACT

A wideband electronically scanned cylindrical array includes an array of end-fire radiating elements, the elements arranged in a first plurality of columns, the columns arranged radially about a center axis of the array. A beamforming network is connected to the array of radiating elements. The beamforming network includes a power divider circuit for dividing an input RF drive signal into a second plurality of drive signals, and a matrix of electronically controlled transfer switches. A true time delay network comprising a third plurality of delay lines couples respective ones of the drive signals to the matrix of transfer switches. A third plurality of transmit amplifiers is coupled to the matrix of transfer switches, each amplifier for amplifying a respective one of the drive signals. The beamforming network further includes apparatus for coupling the amplified drive signals to selected ones of the columns of radiating elements. A beamforming controller is connected to the coupling apparatus and the matrix of transfer switches for selecting sectors of the columns of radiating elements to be driven by the drive signals to form a desired beam. The columns of radiating elements are arranged in a circularly symmetric fashion about the axis in the disclosed embodiment.

18 Claims, 3 Drawing Sheets

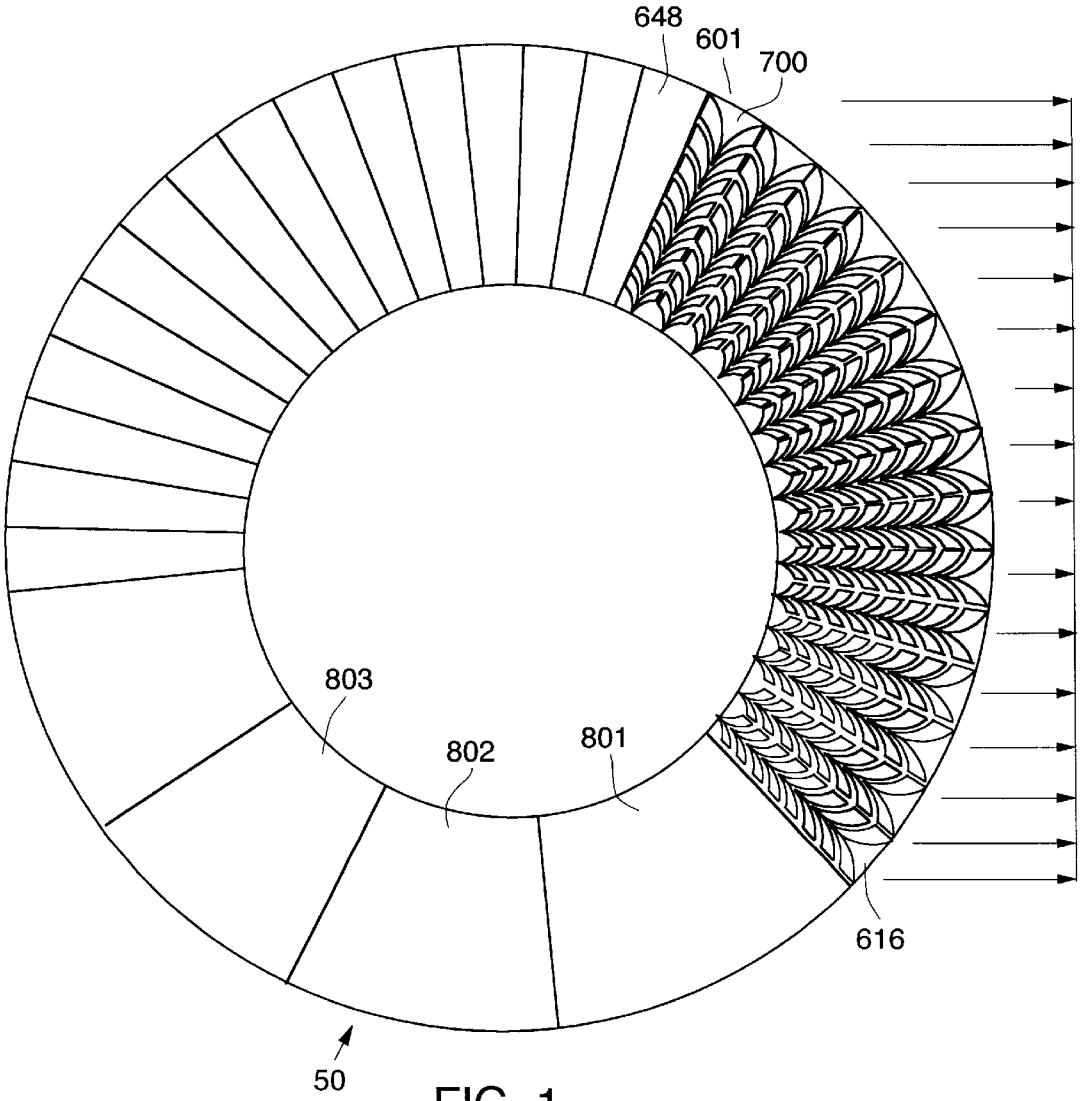
FIG. 1
FIG. 2
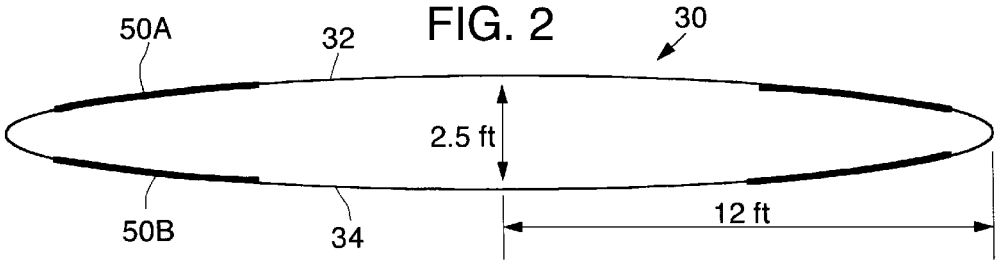
FIG. 3
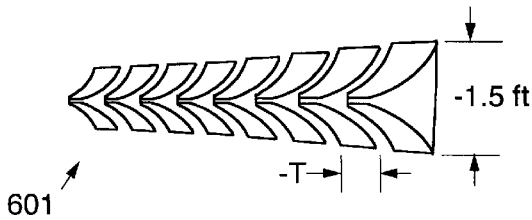

WIDEBAND CYLINDRICAL UHF ARRAY

CROSS-REFERENCE TO RELATED APPLICATION

This application is related to commonly assigned, co-pending application Ser. No. 08/807,522, filed Aug. 8, 1997, entitled WIDEBAND END-FIRE UHF ARRAY, the entire contents of which are incorporated herein by this reference.

TECHNICAL FIELD OF THE INVENTION

This invention relates to antenna arrays, and more particularly to a wideband cylindrical UHF array.

BACKGROUND OF THE INVENTION

Naval vessels face a complex hostile environment represented by a variety of emerging threats, among which is the small and low flying cruise missile (CM). It is important to detect, track, and classify these small targets with sufficient range to deploy CM defense.

A known antenna for an airborne early warning (AEW) radar is a passive array housed in a 24 ft rotadome mounted atop an aircraft fuselage and mechanically turned at a slow rate of 10 seconds per revolution. Its performance is inadequate to detect, track, and classify small, fast, and low flying cruise missiles.

SUMMARY OF THE INVENTION

An Electronically Scanned Array (ESA) in accordance with this invention is one of the most effective ways to improve the AEW radar's performance. An electronically scanned array in accordance with the present invention offers reliability, lower round trip loss, and beam agility to much enhance the radar performance against these potent threats and similar targets. The active array enjoys a much lower round trip loss and a soft fail feature offered by a multi-channel approach.

A wideband electronically scanned cylindrical array in accordance with an aspect of the invention includes an array of end-fire radiating elements, the elements arranged in a first plurality of columns, the columns arranged radially about a center axis of the array. A beamforming network is connected to the array of radiating elements. The beamforming network includes a power divider circuit for dividing an input RF drive signal into a second plurality of drive signals, and a matrix of electronically controlled transfer switches. A true time delay network comprising a third plurality of delay lines couples respective ones of the drive signals to the matrix of transfer switches. A third plurality of transmit amplifiers is coupled to the matrix of transfer switches, each amplifier for amplifying a respective one of the drive signals. The beamforming network further includes apparatus for coupling the amplified drive signals to selected ones of the columns of radiating elements. A beamforming controller is connected to the coupling apparatus and the matrix of transfer switches for selecting sectors of the columns of radiating elements to be driven by the drive signals to form a desired beam. The columns of radiating elements are arranged in a circularly symmetric fashion about the axis in the disclosed embodiment.

The coupling apparatus in an exemplary embodiment comprises a fourth plurality of selector switches controlled by the beamforming controller, each selector switch for selectively connecting a corresponding amplified drive signal to one of a fifth plurality of the columns of radiating elements. The beamforming network can include a sixth plurality of phase shifter elements, each respectively connecting the matrix of transfer switches to a corresponding transmit amplifier.

According to another aspect of the invention, the power divider circuit, the true time delay network, the matrix of transfer switches and the phase shifters are low power elements.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a diagrammatic top view of an electronically scanned cylindrical array embodying this invention.

FIG. 2 is a side cross-sectional view of the array of FIG. 1.

FIG. 3 is a top view of one column of end-fire elements comprising the array of FIG. 1.

DETAILED DESCRIPTION OF THE PREFERRED EMBODIMENT

Figure 4:
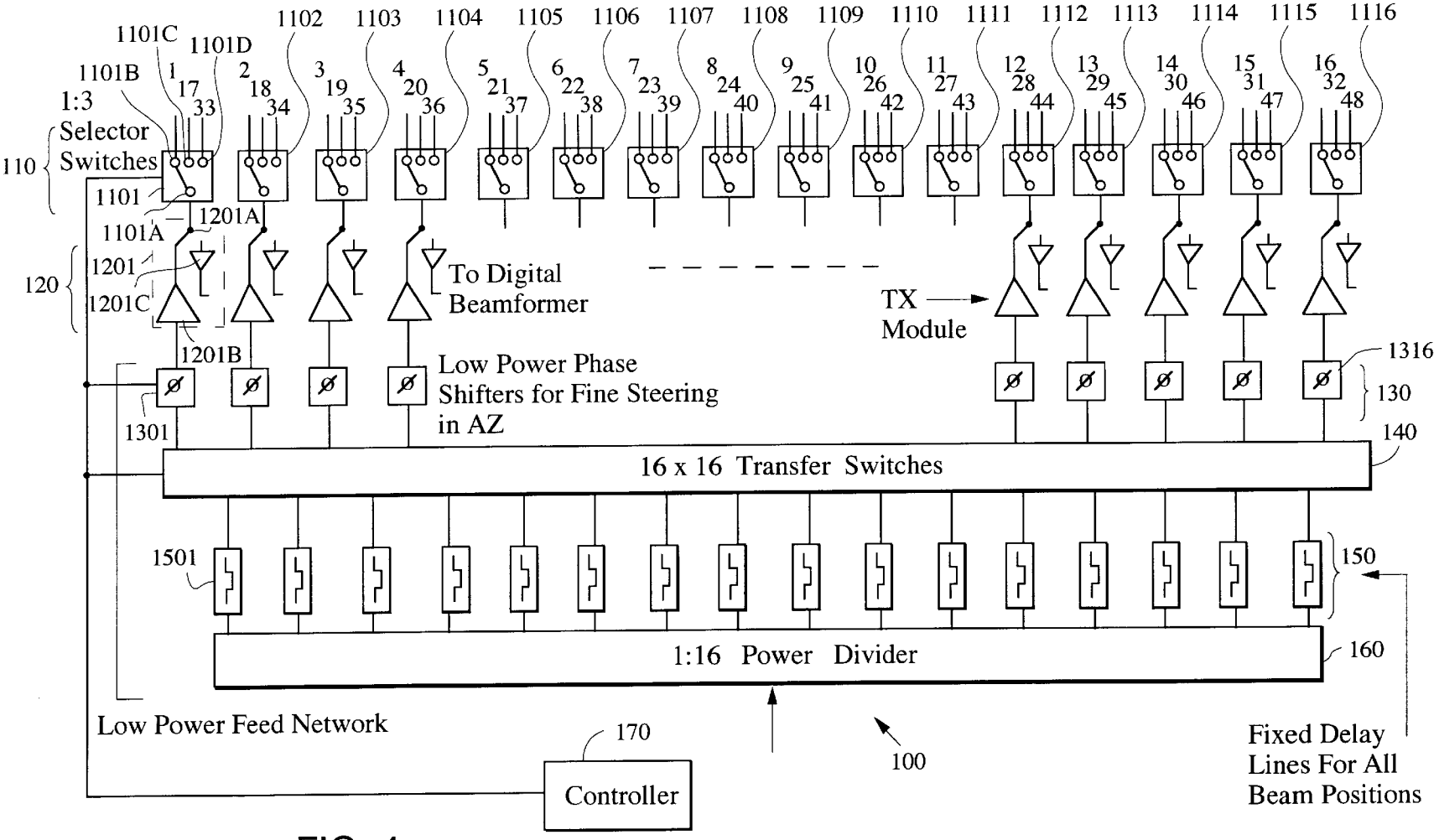
FIG. 4 is a schematic diagram of an exemplary beam forming network for the transmit and receive modes of the array of FIG. 1.

In an exemplary form, an array antenna in accordance with this invention is a non-rotating cylindrical wideband array 50 conformal to a radome mounted on a top surface of an aircraft fuselage, with its beam controlled by a commutation switch matrix to provide 360 degrees coverage. Referring to FIGS. 1–3, an exemplary array 50 is a conformal cylindrical array with 48 columns 601–648 of end-fire elements 700, which are controlled by a fast-switching (on the order of 10 microsecond) beamforming network 100 (shown in FIG. 4) capable of 360 degree scan in the azimuth plane. To reduce the elevation (EL) beamwidth and maximize the end-fire gain, two decks 50A, 50B of elements are used, adjacent and conformal to the upper and lower surfaces 32, 34 of the radome 30 in a double-deck arrangement. The end-fire elements may alternatively be embedded in the skin of the saucer-shape radome 30. Essentially, each deck has a complete 48-column array as shown in FIG. 1, with respective corresponding columns of each deck array in vertical alignment. To reduce the elevation beamwidth, the corresponding columns of the two decks of arrays should be separated by a distance of between about $0.5\lambda$ and $1.0\lambda$.

The array antenna is housed in the radome 30 without the need for a rotary joint and moving parts as in known mechanically scanned designs. This is because the array is electronically scanned.

The 48 columns 601–648 of the array are grouped in 4-column bays, with 3 bays 801, 802, 803 shown in schematic form in FIG. 1. In an exemplary embodiment, on the order of 22 dB directivity is achieved with 20 kW average power produced by 16 solid state modules driving the columns, i.e. one solid state module per bay in a multi-channel architecture. In this embodiment, the high power modules are located within the radome next to the radiating elements, significantly reducing transmit loss. Thus, the active array 50 enjoys a much lower round trip loss, and a soft fail feature offered by the multi-channel approach, since failure of one solid state module does not result in loss of the entire array functionality.

FIG. 3 illustrates an exemplary one (601) of the columns of radiating elements. Each column 601–648 is an eight-element end-fire subarray. The columns are tapered in size from a larger width at the outer periphery of the array to a smaller width at the interior of the channel. The tapering enables the columns to be fitted into a circular array configuration, with the columns extending radially outward. The tapering is not believed to have a significant effect on the electrical properties of the array. The radiating element 700 is a variation of a flared notch design, and is described more particularly in commonly assigned U.S. Pat. No. 5,428,364, the entire contents of which are incorporated herein by this reference.

The exemplary end-fire subarray shown in FIG. 3 has an element spacing of 6.5" (16.5 cm), equal to one quarter wave length at 450 MHz. The spacing was chosen to produce an end-fire beam in only one direction as opposed to a bi-directional case with a half wave length spacing. The end-fire subarray is well behaved from 300 to 800 MHz because the elements support wideband and a true time delay feed network is used. The subarrays are described in further detail in the above-reference application Ser. No. 08/907,522, WIDEBAND END-FIRE ARRAY.

In an exemplary embodiment, the array can support an octave bandwidth from 300 to 800 MHz. This wide bandwidth provides great potential to detect small targets with enhanced radar cross section at the low end, and offers better range resolution and target imaging with 500 MHz bandwidth. Of course, the invention is not limited to arrays of this frequency band, but instead can be used in other frequency ranges and bandwidths.

FIG. 4 is a schematic of the beamforming network 100 for the transmit and receive modes for the array 50. The feed network 100 includes a high power, low loss commutation switch matrix 110 to switch the beam around the azimuth plane. For this embodiment, there are 16 switches 1101–1116, each for selectively connecting a port on one side of the switch to one of three ports on a second side of the switch. Thus, for example, switch 1101 selectively connects the port 1101A to one of three ports 1101B–1101D. This provides the capability to selectively connect to one of three columns of radiating elements in the array. In this exemplary embodiment, the selector switch 1101 is for selectively connecting the feed network to one of columns 601, 617 and 633 comprising the array.

The network 100 further includes an array 120 of 16 transmit/receive (T/R) modules, each module including a T/R switch, a transmit module including a high power transmitter, and a low noise amplifier. For example, exemplary module 1201 includes T/R switch 1201A, transmit amplifier 1201B, and low noise receive amplifier 1201C. The switch connects the radiating element side of the module to either the transmit amplifier (transmit mode) or to the low noise receive amplifier (receive mode). The outputs of the receive amplifiers are sent to a digital beamformer (not shown). The inputs to the transmit amplifiers are from the network 130 of low power phase shifters which provides the capability of fine steering in azimuth. There are 16 phase shifters 1301–1316 comprising the network 130.

The network 100 further includes a 16×16 matrix 140 of transfer switches, connected between the fixed delay line network 150 and the 1:16 power divider 160 which receives the RF input signal for the transmit mode. The matrix 140 has 16 output ports connected to the network 150, and 16 input ports connected to the divider 160. For wideband operation a time delay feed network 150 is included, for connecting the RF drive signal from the power divider to the transfer switches. There are 16 delay lines 1501–1516 comprising the time delay feed network; each of the delay lines is fixed and common to all beam positions. In conjunction with the 1:3 commutation switches 1101–1116 at the output, the (16×16) transfer switch matrix correspondingly maps these delay lines into the 16 columns on the array circle to equalize the differential time delays for any beam direction. In this exemplary embodiment, the equalization of differential time delays is employed to produce a set of possible beams, each having a planar energy wavefront, e.g. as shown in FIG. 1. There are 48 beam positions in total with 7.5 degrees per step, thus providing overlapping coverage in azimuth and 360 degree coverage. Using this switch matrix 140, 16 of the 48 columns of end-fire elements can be fed for any given beam direction with the same fixed time delay network. The purpose of the switch matrix 140 is to equalize the time delay for any of the possible beam directions, by selectively connecting the fixed time delay lines to the columns selected by the selector switches 110. The selector switches 110 serve to select the appropriate columns to form a beam in a desired direction.

The elements of the feed network 100 can all be physically contained in the radome 30. The power divider 160 can, for example, be a pillbox circuit or Rotman lens, each of which is well known in the art.

The switches 110 and 140, phase shifters 130, and the T/R switches are electronically controlled by the system controller 170. The switching time, less than 10 microseconds, is accomplished by the electronic switches comprising the switch matrix 140 and the selector switches 110. No scan loss is incurred by circular symmetry as opposed to other designs where triangular or four-face planar arrays might be used.

The solid state array 50 can operate at a higher duty cycle (>25%) than the known mechanically scanned system, so the peak power will be much lower. Also, because transmit loss is reduced, the solid state design alleviates the high voltage breakdown and maintenance problems encountered in mechanically scanned systems. The beamforming network includes fixed delay lines for wide band performance, and the system is supplemented with low power phase shifters for refined beam scan. On receive, digital beamforming with photonic links may be used to provide azimuth (AZ) and EL beam agility through adaptive nulling. 16 or 48 channels of fiber optic links may be used for signal and data remoting. Antenna remoting and signal processing using photonic links at UHF is relatively easy to achieve at low cost.

Each sector of columns selected by the selector switches 110 in this exemplary embodiment includes 16 columns, to generate an energy wave front as shown in FIG. 1. A planar wave front can be generated, because time delays in signal propagation times are corrected by differential line lengths in the lines comprising the network 150.

Figure 5:
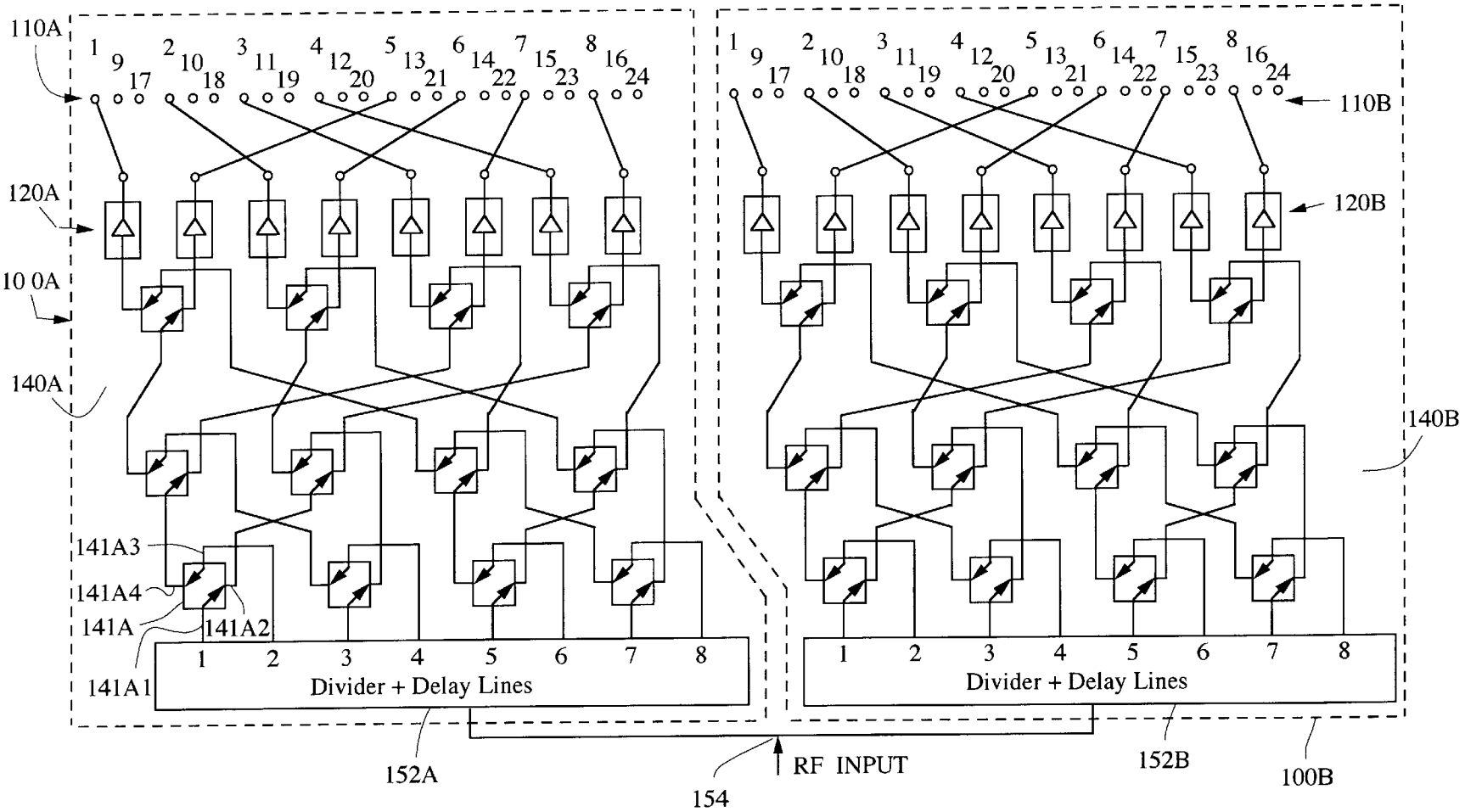
FIG. 5 is a schematic diagram of an exemplary matrix of transfer switch suitable for feeding the array of FIG. 1.

FIG. 5 is a schematic diagram showing an exemplary feed network 100 for the array system 50, comprising two identical sub-networks 100A, 100B used to feed the 16 columns of the array selected by the selector switches. Sub-network 100A includes the 8×8 switch matrix 140A, the set of transmit modules 120A and the set of selector switches 110A. Sub-network 100B includes the switch matrix 140B, the set of transmit modules 120B and the set of selector switches 110B. The switches comprising the matrices 140A, 140B are double pole, double throw switches. Thus, for example, switch 141A has terminals 141A1–141A4. In a first switch position shown in FIG. 5, terminal 141A1 is connected to terminal 141A2, and terminal 141A4 is connected to terminal 141A3. In the second switch position, terminal 141A1 is connected to terminal 141A3, and terminal 141A4 is connected to terminal 141A2.

For simplicity, the phase shifters are not shown in FIG. 5, and the power divider and delay lines are shown in combined blocks 152A and 152B. A power divider 154 divides the RF input signal into two signals, one for each subnetwork.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A wideband electronically scanned cylindrical array, comprising:

an array of end-fire radiating elements, the elements arranged in a first plurality of columns, the columns arranged radially about a center axis of the array;

a beamforming network connected to the array of radiating elements, the beamforming network including;

a power divider circuit for dividing an input RF drive signal into a second plurality of drive signals;

a matrix of electronically controlled transfer switches;

a true time delay network, comprising a third plurality of delay lines coupling respective ones of said drive signals to said matrix of transfer switches;

a fourth plurality of transmit amplifiers coupled to said matrix of transfer switches, each amplifier for amplifying a respective one of the drive signals;

apparatus for coupling said amplified drive signals to selected ones of said columns of radiating elements, said selected columns forming a fifth plurality of columns; and a beamforming controller connected to the coupling apparatus and the matrix of transfer switches for selecting sectors of said columns of radiating elements to be driven by said drive signals to form a desired beam.

2. The array of claim 1 wherein said coupling apparatus comprises a sixth plurality of selector switches controlled by said beamforming controller, each selector switch for selectively connecting a corresponding amplified drive signal to one of said fifth plurality of said columns of radiating elements.

3. The array of claim 1 wherein said columns of radiating elements are arranged in a circularly symmetric fashion about said axis.

4. The array of claim 1 further comprising a seventh plurality of phase shifter elements, each respectively connecting said matrix of transfer switches to a corresponding transmit amplifier.

5. The array of claim 4 wherein said phase shifters are variable phase shift devices controlled by said beamforming controller to provide fine steering adjustment capability.

6. The array of claim 4 wherein said power divider circuit, said true time delay network, said matrix of transfer switches and said phase shifters are low power elements.

7. The array of claim 1 further comprising a radome for housing said columns of radiating elements.

8. The array of claim 1 wherein each of said third plurality of delay lines includes a first line end connected to a power divider output port and a second end connected to said matrix of transfer switches, and wherein said matrix of transfer switches is adapted to selectively connect each of said second line ends to an input of a selected one of said transmit amplifiers.

9. The array of claim 1 wherein said columns are arranged in a circularly symmetric fashion about said axis, and said fifth plurality of columns is equal in number to one third of the number of columns in said first plurality.

10. The array of claim 1 wherein said power divider circuit is adapted to equally divide said drive signal into said second plurality of drive signals.

11. The array of claim 1 wherein each of the delay lines is fixed in length and common to all beam positions.

12. The array of claim 1 wherein said matrix is adapted to map said third plurality of delay lines into said fifth plurality of columns to equalize the differential time delays for any beam direction.

13. A wideband electronically scanned cylindrical array, comprising:

a first array of end-fire radiating elements, the elements arranged in a first plurality of columns arranged radially about a center axis of the array;

a second array of end-fire radiating elements, the elements arranged in a second plurality of columns arranged radially about said center axis;

the first array and second arrays disposed as upper and lower decks of an antenna system;

a beamforming network connected to the first and second arrays of radiating elements, the beamforming network including;

a power divider circuit for dividing an input RF drive signal into a third plurality of drive signals;

a matrix of electronically controlled transfer switches;

a true time delay network, comprising a fourth plurality of delay lines coupling respective ones of said drive signals to said matrix of transfer switches;

a fifth plurality of transmit amplifiers coupled to said matrix of transfer switches, each amplifier for amplifying a respective one of the drive signals;

apparatus for coupling said amplified drive signals to selected ones of said first and said second pluralities of columns of radiating elements, said selected columns forming a fifth plurality of columns; and a beamforming controller connected to the coupling apparatus and the matrix of transfer switches for selecting sectors of said columns of radiating elements to be driven by said drive signals to form a desired beam.

14. The system of claim 13 wherein said coupling apparatus comprises a sixth plurality of selector switches controlled by said beamforming controller, each selector switch for selectively connecting a corresponding amplified drive signal to one of said fifth plurality of said columns of radiating elements.

15. The system of claim 13 further comprising a radome for housing said columns of radiating elements and said beam forming network.

16. The system of claim 13 wherein each of said fourth plurality of delay lines includes a first line end connected to a power divider output port and a second end connected to said matrix of transfer switches, and wherein said matrix of transfer switches is adapted to selectively connect each of said second line ends to an input of a selected one of said transmit amplifiers.

17. The system of claim 13 wherein each of the delay lines is fixed in length and common to all beam positions.

18. The system of claim 13 wherein said matrix is adapted to map said fourth plurality of delay lines into said sixth plurality of columns to equalize the differential time delays for any beam direction.

* * * * *